US005103956A

United States Patent [19]

Jang

[11] Patent Number: 5,103,956

[45] Date of Patent: Apr. 14, 1992

[54] GOODS SELLING CONTROL SYSTEM FOR A VENDING MACHINE

[75] Inventor: Bo H. Jang, Suweon, Rep. of Korea

[73] Assignee: SamSung Electronics Co., Ltd., Suwon, Rep. of Korea

[21] Appl. No.: 575,628

[22] Filed: Aug. 31, 1990

[30] Foreign Application Priority Data

Dec. 30, 1989 [KR] Rep. of Korea ..... UM89/20834

[51] Int. Cl.[5] ..... G07F 9/08; G07F 11/00

[52] U.S. Cl. ..... 194/217; 221/5; 221/129

[58] Field of Search ..... 194/216, 217, 218; 221/125, 126, 129, 5

[56] References Cited

U.S. PATENT DOCUMENTS 3,478,855 11/1969 Seversen ..... 194/216 X 3,894,220 7/1975 Levasseur ..... 194/218 X

*Primary Examiner*—F. J. Bartuska

*Attorney, Agent, or Firm*—Robert E. Bushnell

[57] ABSTRACT

A control device for a vending machine to provide a goods selling control system having relatively simpler goods selecting control to sell goods selected among various goods to be purchased by the user. The control device has one or more switches that are on a goods selecting keyboard, a designating signal generation device for outputting a specific signal identifying the pressing of a switch, a goods displaying device for displaying goods corresponding to the specific signal, a goods releasing device for controlling the release of the designated goods and a coin mechanism for authenticating coins. The coin mechanism identifies the coin, a goods designating signal from a designating signal generation device is applied to a goods releasing control device, the selected goods are released out of the vending machine as the purchaser presses the goods selling switch, then the goods selling end signal from the goods releasing control device is sent into the coin mechanism as well as clears the designating signal generation device thereby to return the invention to its original state, capable of selling goods again.

21 Claims, 1 Drawing Sheet

GOODS SELLING CONTROL SYSTEM FOR A VENDING MACHINE

BACKGROUND OF THE INVENTION

The invention is related to providing a vending machine for automatically selling various goods, and particularly to providing a goods selling control system for commercially and easily selecting goods among various goods to be purchased by a purchasing user.

Recently, it has been the tendency to use an automatic vending machine for selling various goods with minimal human power required. As an illustrative example, a vending machine having a CPU controlling all operations for selling goods with a device for authenticating coins which are inserted therein, inputting coin acceptance/authentication signals into said CPU, a device for detecting an over-payment giving back change, generating change return detecting signals to said CPU, a device for giving back change under control of said CPU, a device for generating clock signals for said CPU, a price setting switch and selling price setting device for setting the selling price of goods stacked on each column and inputting the set price signal into the CPU, a goods selling out detection switch and detecting device for detecting the selling out of goods stacked on each column, a device for detecting the completion of the goods sold, a device for displaying the columns able to sell goods, a device for displaying the columns with goods sold out, a device for releasing goods through a chute which is accessible to a user, and a device for displaying an amount of money such as coins, or rejecting pennies, etcetera.

Therefore, a conventional vending machine includes a goods displaying device and goods selecting switches in a one to one to correspondence to the types of goods available for sale, so that the user can obtain his selection by pressing the goods selecting switch corresponding to the item desired.

The typical conventional example is disclosed in Japan Utility Model Publication Sho 61-42230, in which a timing signal generation portion outputs the address signals for sequentially scanning a plurality of columns, one or more selling out instruction switches respectively connected in series to a matrix diode of each of the selling columns, a matrix diode circuit includes a plurality of matrix diodes to get its output control to be determined by said address signals and said selling out instruction switches, and a selling determination means compares a selling price of goods stacked on each columns with an amount of authenticated coins and may deny the selling of goods, and said matrix diodes are in the form of light emitting diodes.

But, this apparatus is also the same as a conventional apparatus in that it must be provided with at least one selecting button for each type of goods for sale, and goods selected by the user are displayed, and each of the goods selections are controlled.

Such conventional vending machines are constructed in a way to have only one selecting button corresponding to one goods item, for example if one vending machine sells one hundred goods, it has one hundred selecting buttons mounted on its front. Also, selecting buttons must be easily accessed by the purchaser. Therefore, there are many problems due to numerous selecting buttons, it is difficult to design as well as manufacture the vending machine, and erroneous selecting by the purchaser frequently occurs.

Accordingly, the object of the invention is to provide a goods selling control system including a relatively simpler goods selecting control system to sell goods selected among various goods to be purchased by the user.

SUMMARY OF THE INVENTION

The invention comprises a goods selling control system provided with a goods selecting control device including one or more switches that are goods selecting means as parts of a keyboard, a designating signal generation device for outputting a specific signal identifying the press of a switch, a device for displaying goods corresponding to the specific signal, a device for controlling the releasing of goods designated and a coin mechanism for authenticating coins, in which after a coin mechanism identifies a coin, the goods designating signals from a designating signal generation device are applied to a goods releasing control device, goods selected are released out of a vending machine as the purchaser presses the goods selling switch, then the goods selling end signal from a goods releasing control device is sent into a coin mechanism as well as clearing a designating signal generation device thereby to return to the original state capable to sell goods again.

BRIEF DESCRIPTION OF THE DRAWINGS

The invention will be described in detail with reference to the accompanying drawings, in which.

DETAILED DESCRIPTION OF THE INVENTION

Figure 1:
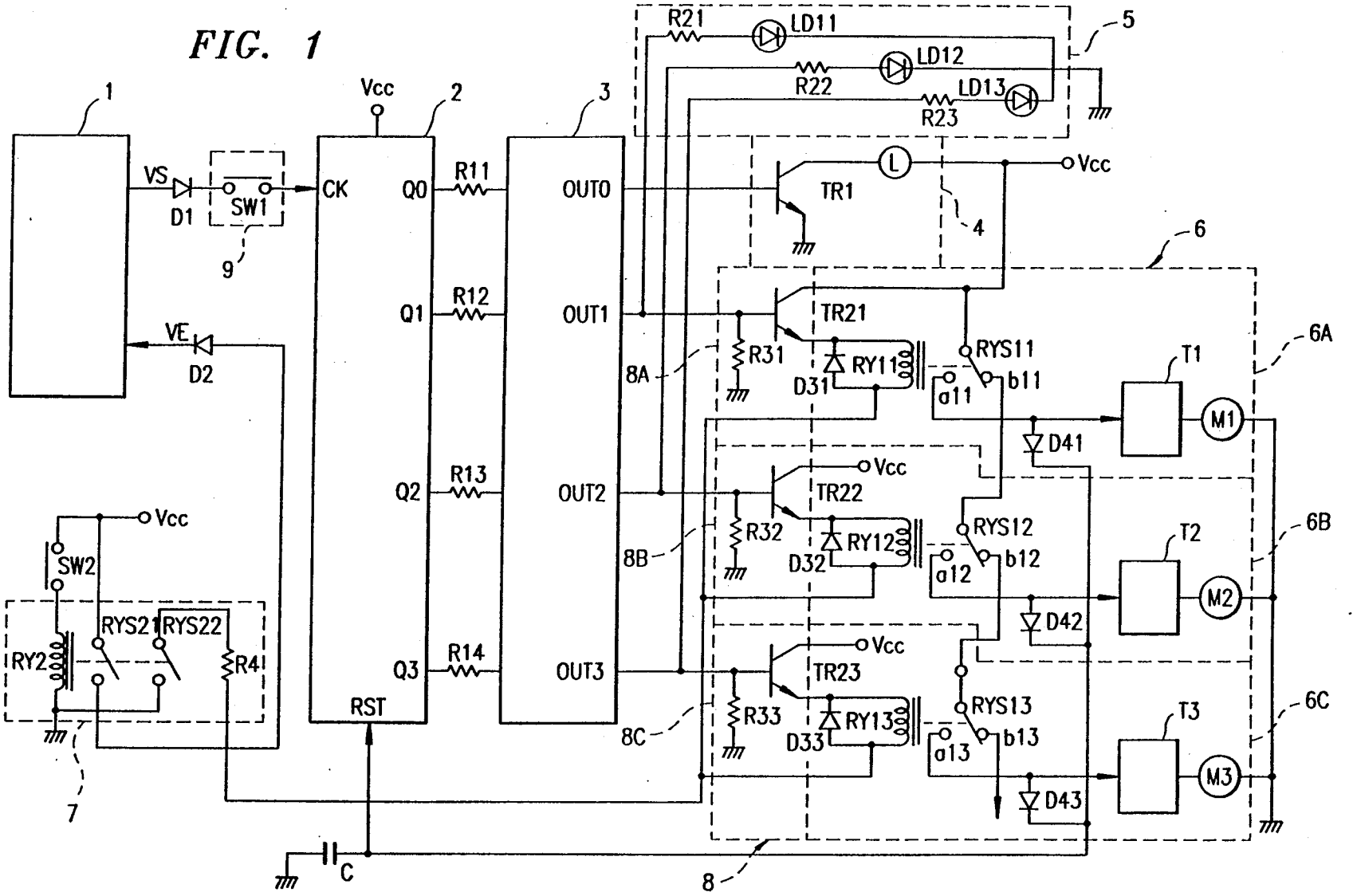
FIG. 1 is a circuit illustrating one embodiment of a goods selling control system according to the invention.

Referring to FIG. 1, the invention comprises coin mechanism 1, counter 2 referred to as the designating signal generator, buffer 3, selling enable display 4, goods designating display 5, goods releasing device 6 provided with a plurality of goods releasing drives 6A, 6B, 6C... and a plurality of relay driving controllers 8A, 8B, 8C..., and goods releasing controllers 7 and goods selecting device 9 having one switch which is shown in the drawing.

Coin mechanism 1 is connected at its terminal VS through diode D1 and goods selecting device 9 to counter 2 and is connected at its terminal VE through diode D2 to goods releasing controller 7.

Counter 2 has terminal CK for receiving a signal from coin mechanism 1, terminal RST is initialized by a signal from goods releasing device 6 and four or more terminals Q0, Q1, Q2, Q3 connected through resistors R11, R12, R13, R14, respectively, to buffer 3.

Buffer 3 has four or more terminals OUT0, OUT1, OUT2, OUT3 connected to selling enable display 4 and relay driving controllers 8A, 8B, 8C, respectively.

Selling enable display 4 includes lamp L and transistor TR1 for operating lamp L according to receiving a signal from terminal OUT0 of buffer 3.

Goods designating display 5 is provided with a plurality of display groups, including resistor R21 and light emitting diode LD11, resistor R22 and light emitting diode LD12, and resistor R23 and light emitting diode LD13, etc. all connected to terminals OUT1, OUT2, OUT3, etc., respectively.

Relay driving controllers 8A, 8B, 8C, etc. each have a transistor TR21, TR22, TR23, etc. with bases saturated in response to each of outputs OUT1, OUT2, OUT3, etc. of buffer 3 and a resistor R31, R32, R33, etc., respectively, in which each of transistors TR21, TR22, TR23, etc. is connected at their collector to power source $V_{cc}$ and at their emitters to each of goods releasing drives 6A, 6B, 6C, etcetera.

Goods releasing drives 6A, 6B, 6C, etc. include one of relays RY11, RY12, RY13, etc. and one of relay switches RYS11, RYS12, RYS13, etc. cooperating with relays, one of timers T1, T2, T3, etc., and one of motors M1, M2, M3, etc., operated by the control of timers for a predetermined period, respectively, in which each of relays RY1, RY2, RY3 has diodes D31, D32, D33 for preventing reverse current and is connected to goods releasing control 7, each of ready switches RYS11, RYS12, RYS13 has two fixing terminals all and b11, a12 and b12, a13 and b13, and each of terminals all, a12, a13 is connected to one of timers as well as is connected through diodes D41, D42, D43, respectively, to terminal RST of counter 2 so as to control the operation of counter 2.

Goods releasing control 7 includes purchasing button switch SW2 connected at one end to power source $V_{cc}$, relay RY2 connected to the other end of button switch SW2 and relay switches RYS21 and RYS22 cooperating with relay RY2, in which relay switch RYS22 is connected through resistor R4 in common to all of relays RY11, RY12, RY13, and relay switch RYS21 is connected through diode D2 to terminal VE of coin mechanism 1.

Therefore, when the consumer inserts coins into a vending machine, coin mechanism 1 performs functions of: authentication of coins, display of an amount of money inserted, generation of the selling allowance signal, detection of goods selling out, and the display thereof of the absence of goods, and the return of the change when detecting overpayment. A detailed description of these functions is omitted since the techniques are well known by one of ordinary skill in the art.

On the other hand, according to the invention we assume that coin mechanism 1 generates the selling enable signal VS, which is the power voltage at a predetermined level, to apply it through diode D1 to one end of goods selecting switch SW1. Goods selecting switch SW1 is connected at its other end to clock terminal CK of counter 2 for generating the goods designating signal. Counter 2 receives clock pulses corresponding to the number of times input by pressing switch SW1 one at a time or in a digital format of a keyboard from its clock terminal CK, in which counter 2 may be commercially acquired as TTL IC No. 74142 known as BCD Counter/Decoder for counting/decoding the clock pulses received. Thus, counter 2 counts a number of clock pulses as well as outputs a signal decoded in accordance to the counted value at a predetermined terminal, for example Q1, Q2 or Q3, in which the decoded signal is referred to below as the designating signal having the high signal level of Logic High.

Then, terminals Q1, Q2, Q3 are output terminals of counter 2 nominally having 10 terminals. Terminal Q0 belonging to counter 2, as shown in FIG. 1, is differentiated from terminals Q1, Q2, and Q3 with being floated, because it is independent of the function of counter 2. That is, terminal Q0 may be connected directly to the anode of diode D1 or may be arranged to have a logical 0R configuration through a predetermined diode connected to each of terminals Q1, Q2, Q3, even though not drawn in FIG. 1. Thus, selling enable signal VS from coin mechanism 1 is applied through resistor R11 and buffer 3 to selling enable display 4 to display only the selling enable state. Otherwise when switch SW1 is pressed, the designating signal selectively passes through each of diodes connected in a logical OR configuration to terminals Q1, Q2, Q3 and then is applied through resistor R11 and buffer 3 to selling enable display 4 to simultaneously display the selling enable state and the goods designating state as will be described in detail below.

If terminal Q1 outputs the designating signal of Logic High, other terminals Q2 and Q3 are in the low signal level of Logic Low. The designating signal from terminal Q1 is applied through resistor R12 and terminal OUT1 of buffer 3 to transistor TR21 of relay driving controller 8A. Similarly, according to designating goods by the selecting operation of selecting switch SW1, the designating signals from terminal Q2 and Q3 can selectively be applied through resistors R13 or R14 and buffer 3 to one of relay driving controllers 8B and 8C. At this time, the output signals of buffer 3 turn on lamp L and one of light emitting diodes LD11, LD12, LD13 to display the selling enable state or the designating of goods.

On the other hand, according to the embodiment of the invention, three goods releasing drives 6A, 6B, 6C and three relay driving controls 8A, 8B, 8C are shown in the drawing, but terminals OUT0 ... OUTN of buffer 3, goods displaying light emitting diodes LD1 LDN and their associated components R21... RN, goods ejecting drive devices 6A ... 6N, and relay driving controllers 8A ... 8N can be increased by predetermined desired numbers to constitute an apparatus for selecting/selling the numerous goods in a simple configuration.

According to another embodiment of the invention, goods selecting switch SW1 can be constituted as a goods selecting device having a plurality of switches which are expressed in a predetermined figure corresponding to a button of 0 to 9. A designating signal generator, such as counter 2, generates the goods designating signal in turn corresponding to the selecting of switches of the goods selecting device 9, in the manner that it decodes the specific number, for example 2, considered as hundred or a unit of three figures previously determined, then the specific number 8 considered as ten or a unit of two figures and the specific number 9 considered as one or a unit of one figure in turn, for example 289. Then, the designating signal generator 2 applies the designating signals selectively to a plurality of goods releasing devices with a relay drive controller 8 and a goods releasing drive controller 6, so that it may designate the predetermined goods releasing devices having goods to be selected.

Returning to FIG. 1, as the designating signal is applied to one of relay driving controllers 8A, 8B, 8C, one of transistors TR21, TR22, TR23 in relay driving controllers is selectively saturated, while one of light emitting diodes LD1, LD2, LD3 connected to the outputs of buffer 3 with relay driving controllers A, 8B, 8C turns on to identify goods to be purchased by the user.

Where the predetermined goods are selected, purchasing button switch SW2 is pressed. At this time, relay RY2 is energized by power source $V_{cc}$ to operate relay switches RYS21 and RYS22. Relay switch RYS21 turned on applied power source $V_{cc}$ as the selling end signal through diode D2 to terminal VE of coin mechanism 1 so as to return coin mechanism 1 to the original condition capable of selling goods. Relay switch RYS22 turned on, forces one of relays RY11, RY12, RY13, which are mounted respectively in goods releasing drive controllers 6A, 6B, 6C, through resistor R4 to be grounded, so that one of relays RY11, RY12, RY13 may be energized by power source $V_{cc}$ which is applied through the transistor saturated as described above. Relays RY11, RY12, RY13 normally get their moving terminals of relay switches RYS11, RYS12, RYS13 to be connected with terminals b11, b12, b13, but during energization they contact their moving terminals with terminals a11, a12, a13.

Thus, when one of relay switches RYS11, RYS12, RYS13 is operated by the relay energization, power source $V_{cc}$ is applied to one of timers T1, T2, T3 as well as to reset terminal RST of counter 2 through one of the diodes D41, D42, D43. At this time, one of the timers T1, T2, T3 operates one of the motors Ml, M2, M3 connected respectively thereto, to release the selected goods and counter 2 is initialized to the original state by the signal from any one of diodes D41, D42, D43. Similarly, the output of counter 2 based on the designating signal according to the operation of goods selecting device 8 can selectively operate other relay driving controllers and other goods releasing drives of goods releasing device 6 to eject the predetermined desired goods.

As described above, the configuration of a goods releasing control device includes a counter, a buffer and a goods releasing device, designed in a simple way, so that costs for manufacturing a vending machine may be reduced. Also, the invention allows the purchaser to acquire the specific goods to be selected using two or three keyboard switches, even through the goods to be sold are numerous, making goods selecting an easier operation and minimizing errors by the user.

What is claimed is:

1. A goods selling control system for a vending machine, comprising:

a coin mechanism for authenticating coins inserted and displaying a value of said coins inserted into a vending machine and providing a selling enable signal;

goods selecting controller means for selecting goods, having a terminal connected to receive said selling enable signal from said coin mechanism;

goods designating signal generation means for decoding a signal from said goods selecting controller and generating a designating signal designating foods corresponding to selected goods;

relay driving control means for making the designated goods available for sale according to the designating signal generated by said goods designating signal generation means;

goods releasing control means for providing a designating end signal to said coin mechanism to return said coin mechanism to its original state as well as for applying a goods releasing signal to said relay driving control means; and goods releasing drive means for applying a reset signal to said goods designating signal generation means in response to reception of a signal from said relay driving control means and means for ejecting the selected goods.

2. A goods selling control system for a vending machine as claimed in claim 1, wherein said goods selecting controller means is provided with only one switch to select the desired goods according to the frequency said switch is pressed by a user.

3. A goods selling control system for a vending machine as claimed in claim 1, wherein said goods selecting controller means is provided with switching means for designating the number of goods to be purchased.

4. A goods selling control system for a vending machine as claimed in claim 1, wherein said goods designating signal generation means has a number of output terminals to designate a predetermined number of goods to be sold.

5. A goods selling control system for a vending machine as claimed in claim 1, wherein a predetermined number of said relay driving control means and said goods releasing drive means are installed to release goods.

6. The goods selling control system for a vending machine of claim 4, wherein:

said goods selecting control means is provided with a quantity of switches less than the number of selections of goods available to a user while purchasing the goods from the vending machine.

7. The goods selling control system for a vending machine of claim 4, wherein:

a predetermined number of said relay driving control means and said goods releasing drive means are installed, in a quantity sufficient to eject goods for any possible selections of the user.

8. The goods selling control system for a vending machine of claim 6, wherein:

a predetermined number of said relay driving control means and said goods releasing drive means are installed, in a quantity sufficient to eject goods for any possible selections.

9. A goods selling control system for a vending machine, comprising:

a vending machine coin receiving device provided with an output terminal connected in series through a diode and then through goods selecting switch means to a clock terminal located on a counter, and said vending machine coin receiving device provided with an input terminal connected through a second diode to a goods release first relay switch;

a buffer;

said counter provided with at least four output terminals each separately connected through a respective resistor of a first plurality of resistors to a respective input terminal of a plurality of input terminals located on said buffer;

said buffer being provided with a plurality of at least four output terminals each separately connected to a respective base terminal of a plurality of base terminals each located on a respective transistor of a plurality of transistors;

a goods designating display provided with a plurality of light emitting diodes each separately connected through a respective resistor of a second plurality of resistors in a respective output terminal of said plurality of output terminals of said buffer;

a first transistor of said plurality of transistors, provided with a collector terminal connected through a lamp to a power source and said first transistor provided with an emitter terminal connected to a first reference potential;

a plurality of relay driving controls each having a transistor of said plurality of transistors other than said first transistor, wherein each said base terminal of each transistor of said plurality of relay driving controls is also connected through a respective resistor of a third plurality of resistors to said first reference potential and each transistor of said plurality of relay driving controls is provided with a collector connected to said power source.

a plurality of goods releasing drives each corrected to an emitter of a corresponding transistor of said plurality of relay driving controls, and each of said goods releasing drives having a relay connected to control a drive relay switch connected to control a timer connected to a motor for timed operation of said motor, wherein each said relay is connected to a respective diode for preventing reverse current, each said relay is connected to a goods release control device, and each said drive relay switch is proved with a first and second terminal wherein each said first terminal is connected respectively to a said timer and also connected respectively through a diode to a reset terminal located on said counter; and said goods release control device is provided with a purchasing switch coupled between said power source and a goods releaser control relay controlling a goods release first relay switch and a goods release second relay switch.

10. A control device for a vending machine for selling goods, comprising:

coin mechanism means for receiving and authenticating coins inserted therein, for displaying an accumulated value of said coins, and for generating a selling enable signal;

switching means for receiving said selling enabling signal;

means, coupled to said coin mechanism means via said switching means for generating designation signals and a selling enabled signal in dependence upon said selling enabling signal;

a buffer;

first display means for providing a display in response to said selling enabled signal of said means for generating designation signals, via said buffer, indicative of said vending machine being enabled to sell said goods;

second display means for providing a display in response to a plurality of said designation signals, via said buffer, to indicate which of said goods have been selected by a user for purchase by use of said switching means;

release control means for generating release control signals; and output control means for responding to said plurality of said designation signals, received via said buffer, and to said release control signals, by releasing to the user the goods selected for purchase form the vending machine.

11. The control device for a vending machine for selling goods as claimed in claim 10, wherein said switching means comprises a switch having a single pair of poles.

12. The control device for a vending machine for selling goods as claimed in claim 14, wherein said means for generating designation signals comprises:

a counter, having a clock input terminal connected to said switch, for performing a counting function in response to each time said switching means is depressed;

said counter having a plurality of output terminals, wherein one of said plurality of output terminals outputs said selling enabled signal to said buffer; and wherein other ones of said plurality of output terminals output said designation signals to said buffer.

13. The control device for a vending machine for selling goods as claimed in claim 10, wherein said first display means comprises:

a transistor having a base connected to said buffer to receive said selling enabled signal, an emitter connected to ground and a collector; and a lamp connected between said collector and a power source.

14. The control device for a vending machine for selling goods as claimed in claim 12, wherein said second display means comprises:

a plurality of input terminals, connected to a plurality of output terminals of said buffer, for receiving said plurality of said designation signals;

a plurality of light emitting sources;

each of said input terminals being connected to a respective;

one of said light emitting sources.

15. The control device for a vending machine for selling goods as claimed in claim 12, wherein said output control means comprises:

a plurality of relay drivers respectively connected to said plurality of output terminals of said buffer, for receiving said plurality of said desingation signals; and a plurality of releasing drive means enabled by said release control signals and said relay drivers, for performing said releasing of said goods;

each of said plurality of relay drivers comprising a transistor having a base connected to a, said base being connected to a corresponding one of said plurality of output terminals of said buffer for receiving a corresponding one of said plurality of said designation signals, a collector connected to a power source, and an emitter connected to said corresponding one of said releasing drive means.

16. The control device for a vending machine for selling goods as claimed in claim 15, wherein said correspond-ing releasing drive means comprises a plurality of goods releasing drives, each of said plurality of goods releasing drive means comprising:

a relay connected to the emitter of said transistor of a corresponding one of said relay drivers, wherein said relay is further connected to said first release control switch release control means; and a relay switch, controlled by said relay, said relay switch having an input terminal connected to said collector of said transistor of said corresponding one of said relay drivers, a first output terminal connected to a timer for controlling the timing of a goods releasing drive motor, and a second output terminal connected to a diode for providing a reset output signal to a reset terminal of said counter.

17. The control device for a vending machine for selling goods as claimed in claim 16, wherein said release control means further comprises:

a second release control switch for providing a selling end signal to said coin mechanism means to; and a release control relay responsive to the activation of a purchasing switch connected between said release control relay and said power source, said release control relay simultaneously controlling said first and second release control switches.

18. A control device for a vending machine for selling goods, comprising:

coin mechanism means for generating selling enabling signals in response to reception and authentication of coins inserted therein, and for displaying accumulated values of said coins;

switching means for enabling transmission of said selling enabling signal received from said coin mechanism means;

means, coupled to said coin mechanism means via said switching means, for generating designation signals and selling enabled signals in dependence upon said selling enabling signals;

display means, for providing in response to said selling enabled signals, a first display indicative of said vending machine being enabled to sell said goods, and for providing in response to transmission of a plurality of said designation signals via said switching means, a second display indicative of goods selected for purchase by a user by sue of said switching means;

release control means for responding to actuation by the user by generating release control signals; and output control means for responding to said plurality of said designation signals and to said release control signals, by releasing to the user the goods selected for purchase form the vending machine.

19. The control device for a vending machine for selling goods as claimed in claim 18, wherein said means for generating designation signals comprises:

a counter, having a clock input terminal connected to said switching means, for performing a counting function in response to actuation of said switching means by the user;

said counter having a plurality of output terminals, wherein one of said plurality of output terminals output said selling enabled signal; and wherein other ones of said plurality of output terminals output said designation signals.

20. The control device for a vending machine for selling goods as claimed in claim 19, wherein said output control means comprises:

driving means connected for receiving said plurality of said designation signals; and a plurality of releasing means enabled by said release control signals and said for performing said releasing of said goods;

each of said plurality of driving means comprising a switching component connected for responding to a corresponding one of said plurality of said designation signals, and an output port connected to a corresponding one of said releasing means.

21. The control device for a vending machine for selling goods as claimed in claim 20, wherein each of said releasing means comprises:

a relay connected to a corresponding one of said driving means, wherein said relay is further connected to said release control means;

a timer; and a relay switch, controlled by said relay, said relay switch having an input terminal connected to said switching component of said corresponding one of said driving means, a first output terminal connected to said timer for controlling the timing of release of the selected goods, and a second output terminal connected to provide a reset output signal to a reset terminal of said counter.

* * * * *

UNITED STATES PATENT AND TRADEMARK OFFICE

CERTIFICATE OF CORRECTION

PATENT NO. : 5,103,956
DATED : 14 April 1992
INVENTOR(S) : Bo-Hyoun Jang

It is certified that error appears in the above-indentified patent and that said Letters Patent is hereby corrected as shown below:

IN THE TITLE PAGE

Inventor, [75], change "Bo H. Jang" to --Bo Hyoun Jang--:

Column 7 Claim 9

Line 6, after "source", change period "." to semi-colon -- ; --;

Line 17, preceding "with", change "proved" to --provided--;

Line 24, after "goods", change "releaser" to --release--;

Claim 10

Line 56, after "purchase", change "form" to --from--;

UNITED STATES PATENT AND TRADEMARK OFFICE

CERTIFICATE OF CORRECTION

PATENT NO. : 5,103,956
DATED : 14 April 1992
INVENTOR(S) : Bo–Hyoun Jang

It is certified that error appears in the above-indentified patent and that said Letters Patent is hereby corrected as shown below:

Column 8 Claim 14

Line 23, after "respective", delete the semi–colon ";" and delete the paragraph;

Claim 16

Line 52, after "switch", insert --of said--;

UNITED STATES PATENT AND TRADEMARK OFFICE

CERTIFICATE OF CORRECTION

PATENT NO. : 5,103,956
DATED : 14 April 1992
INVENTOR(S) : Bo-Hyoun Jang

It is certified that error appears in the above-indentified patent and that said Letters Patent is hereby corrected as shown below:

Column 9 Claim 18

Line 23, after "by", change "sue" to --use--;

Line 31, after "purchase", change "form" to --from--.

Signed and Sealed this

Fourteenth Day of November, 1995

*Attest:*

*Attesting Officer*

BRUCE LEHMAN

*Commissioner of Patents and Trademarks*